US008358960B2

(12) United States Patent
Okamoto

(10) Patent No.: US 8,358,960 B2
(45) Date of Patent: Jan. 22, 2013

(54) IMAGE HEATING APPARATUS

(75) Inventor: Osamu Okamoto, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 281 days.

(21) Appl. No.: 12/827,058

(22) Filed: Jun. 30, 2010

(65) Prior Publication Data

US 2011/0008084 A1 Jan. 13, 2011

(30) Foreign Application Priority Data

Jul. 10, 2009 (JP) ..... 2009-163695

(51) Int. Cl.
*G03G 15/20* (2006.01)

(52) U.S. Cl. ..... 399/329

(58) Field of Classification Search ..... 399/122, 399/320, 327–329, 343, 346
See application file for complete search history.

(56) References Cited

U.S. PATENT DOCUMENTS

| | | | | |
|---|---|---|---|---|
| 7,392,005 | B2 * | 6/2008 | Kaji et al. | 399/328 |
| 8,175,510 | B2 * | 5/2012 | Nagase | 399/351 |
| 2009/0003900 | A1 | 1/2009 | Shimizu et al. | |

FOREIGN PATENT DOCUMENTS

| | | |
|---|---|---|
| JP | 11-45018 | 2/1999 |
| JP | 2003-91185 | 3/2003 |
| JP | 2008-115014 | 5/2008 |

OTHER PUBLICATIONS

U.S. Appl. No. 12/844,008, filed Jul. 27, 2010.
U.S. Appl. No. 12/827,123, filed Jun. 30, 2010.
U.S. Appl. No. 12/821,410, filed Jun. 23, 2010.
U.S. Appl. No. 12/783,009, filed May 19, 2010.

* cited by examiner

*Primary Examiner* — Hoan Tran
(74) *Attorney, Agent, or Firm* — Fitzpatrick, Cella, Harper & Scinto

(57) ABSTRACT

An image heating apparatus includes an endless belt; a rotatable member, contacting an outer surface of the belt, for forming a nip in which a recording material is nipped and conveyed; a stretcher for stretching the belt; an urging member, contacting an inner surface of the belt, for urging the stretcher by movement of the belt so as to include a contact portion at which the urging member contacts the stretchers; a lubricator for applying a lubricant onto the inner surface of the belt; and a collector, contacting the stretcher downstream of an area in which the stretcher contacts the belt and upstream of the contact portion with respect to a rotational direction of the stretcher, for collecting the lubricant from the stretcher. The collector includes a guide for guiding the lubricant, collected from the stretcher, onto the inner surface of the endless belt.

11 Claims, 5 Drawing Sheets

(a)

(b)

(a)

(b)

(a)

(b)

IMAGE HEATING APPARATUS

FIELD OF THE INVENTION AND RELATED ART

The present invention relates to an image heating apparatus including a belt conveying device in which a lubricant is applied onto an inner surface of an endless belt supported by a supporting member.

As the image heating apparatus, it is possible to use, e.g., a fixing apparatus (fixing device) for fixing a transferred unfixed image on a recording medium (member) or a glossiness-increasing apparatus for increasing the glossiness of the image fixed on the recording material under the application of heat and pressure.

For example, as a constitution of the image heating apparatus for heating the image formed on the recording material, a constitution in which the image was heated at a press-contact portion (in a nip) created by causing a belt conveying device as shown in FIG. 6 to press-contact a heating roller including a heat source has been known.

In the belt conveying device shown in FIG. 6, an endless belt 13 is stretched around a pressing roller 14 and a tension roller 15 and a pressing pad 18 presses the inner surface of the endless belt 13 so that the endless belt 13 is pressed against a heating roller (not shown) to create the nip. Further, between the pressing pad 18 for creating the nip and the tension roller 15, as disclosed in Japanese Laid-Open Patent Application (JP-A) Hei 11-045018, a lubricant application member 16 for applying a lubricant onto the inner surface of the endless belt 13 is disposed.

However, a lubricant O applied onto the inner surface of the endless belt 13 by the lubricant application member 16 is taken from the inner surface of the endless belt 13 by the pressing roller 14, and remains at a contact portion where the pressing roller 14 starts the contact with the pressing pad 18. In the case, the amount of the lubricant on the inner surface of the endless belt is decreased, reducing the durability of the endless belt. Further, there is a possibility that the lubricant remaining at the contact portion moves along the pressing pad or the pressing roller with respect to a longitudinal direction of the pressing pad or the pressing roller to leak from an end portion of the endless belt to the outside of the endless belt.

SUMMARY OF THE INVENTION

A principal object of the present invention is to provide an image heating apparatus capable of decreasing the amount of a lubricant on an inner surface of an endless belt, leaking out of an end portion of the endless belt.

According to an aspect of the present invention, there is provided an image heating apparatus comprising:

an endless belt;

a rotatable member, contactable to an outer surface of the endless belt, for forming a nip in which a recording material is nipped and conveyed;

a stretching member for stretching the endless belt;

an urging member, contacting an inner surface of the endless belt, for urging the stretching member by movement of the endless belt so as to include a contact portion at which the urging member contacts the stretching member;

a lubricant application member for applying a lubricant onto the inner surface of the endless belt; and a collecting member, contacting the stretching member at a position downstream of an area in which the stretching member contacts the endless belt and upstream of the contact portion with respect to a rotational direction of the stretching member, for collecting the lubricant from the stretching member, wherein the collecting member includes a guiding portion for guiding the lubricant, collected from the stretching member, onto the inner surface of the endless belt.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

First Embodiment

Hereinbelow, with reference to the drawings, embodiments of the present invention will be described. However, the dimensions, the materials, the shapes, and the relative arrangements, and the like of constituent elements described in the following embodiments may be appropriately be changed depending on constitutions and various conditions for apparatuses or devices to which the present invention is applied. Therefore, it should be understood that the present invention is not limited to those specifically described in the following embodiments unless otherwise noted specifically.

Further, in the following description, a belt conveying device rotating in press-contact with a roller is exemplified but the present invention is not limited thereto. For example, it is also possible to use the belt conveying device rotating in press-contact with a drum-like member covered with a film and the belt conveying device of a twin belt type in which two belts rotate in press-contact with each other.

Hereinafter, the image forming apparatus including the belt conveying device and the image forming apparatus including the image heating apparatus will be described as an example. In the following, a belt(-type) fixing device for fixing an unfixed image on a recording material is exemplified but the present invention is not limited thereto. For example, other image heating apparatuses such as a glossiness-increasing apparatus for increasing a glossiness of the image by heating the image fixed on the recording material.

Figure 5:
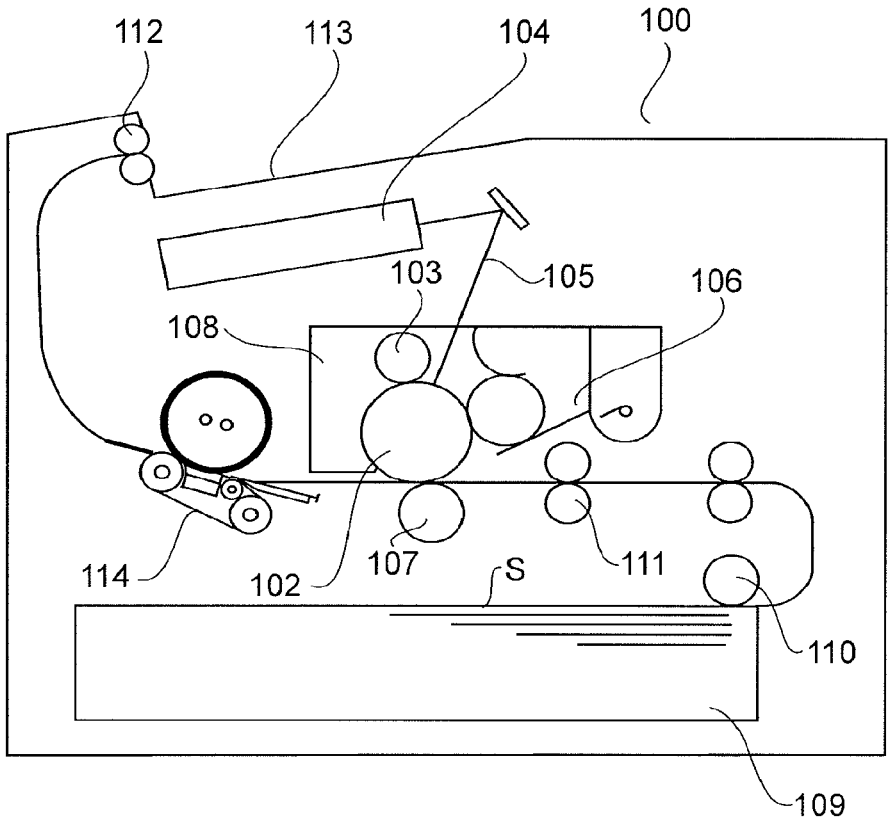
FIG. 5 is a schematic sectional view of an image forming apparatus.

First, with reference to FIG. 5, a general structure of the image forming apparatus including the belt fixing device will be described. FIG. 5 is a longitudinal sectional view showing a schematic structure of the image forming apparatus of an electrophotographic type (so-called printer) as an example of the image forming apparatus including the belt fixing device.

As shown in FIG. 5, parts of an image forming apparatus 100 are roughly classified into an image forming means for forming a toner image on a sheet as the recording material and the belt fixing device as the image heating apparatus for fixing an unfixed toner image formed on the sheet under application of heat and pressure.

First, the image forming means will be described. The image forming means includes the following devices or means. A charger 103 as a charging means is provided opposed to a photosensitive drum 102 as an image bearing member and electrically charges the surface of the photosensitive drum 102 uniformly. The surface of the photosensitive drum 102 is exposed to light 105, depending on the image, emitted from an exposure device 104 as an exposure means, so that an electrostatic latent image is formed on the photosensitive drum 102. On the other hand, a sheet S is accommodated in a sheet feeding cassette 109 disposed at a lower portion of the image forming apparatus 100 and is fed one by one by a sheet feeding roller 110. Then, the sheet S is conveyed by a registration roller pair 111 as a conveying means while being timed to the toner image on the photosensitive drum 102. The toner image on the photosensitive drum 102 is electrostatically transferred onto the sheet S by a transfer roller 107 as a transfer means. After the transfer, the toner remaining on the photosensitive drum 102 is removed by a cleaning device 108 as a cleaning means.

The sheet S on which the toner image has been transferred as described above is conveyed to a fixing device 114. Then, the toner image formed on the sheet S by the image forming means is fixed on the sheet S by being heated and pressed in the fixing device 114 as the image heating apparatus. Thereafter, the sheet S on which the toner image is fixed is conveyed to a discharging roller pair 112 by which the sheet S is discharged onto a discharging tray 113 provided at an upper portion of the image forming apparatus 100.

Figure 1:
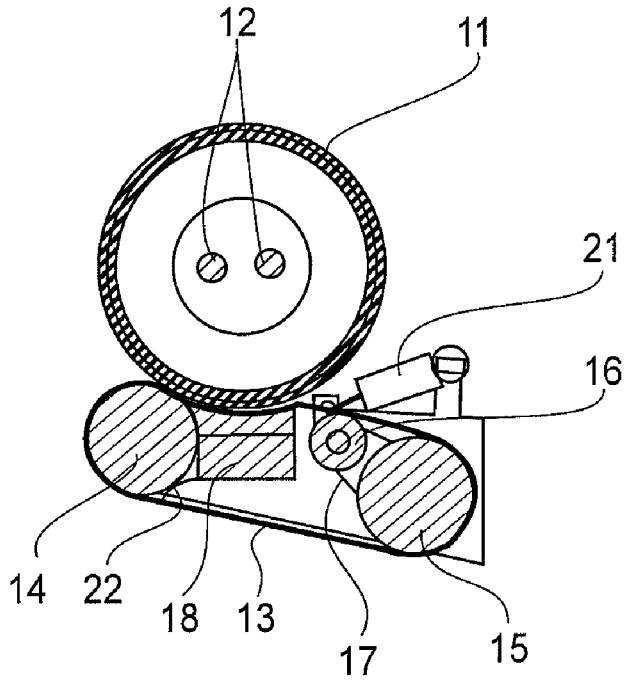
FIG. 1(*a*) is a sectional view of a fixing apparatus (fixing device), and FIG. 1(*b*) is a front view of the fixing device.
Figure 1:
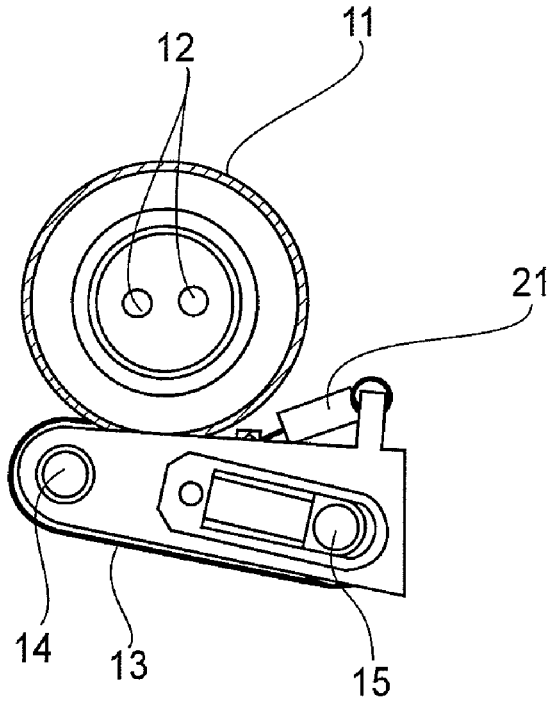
Figure 2:
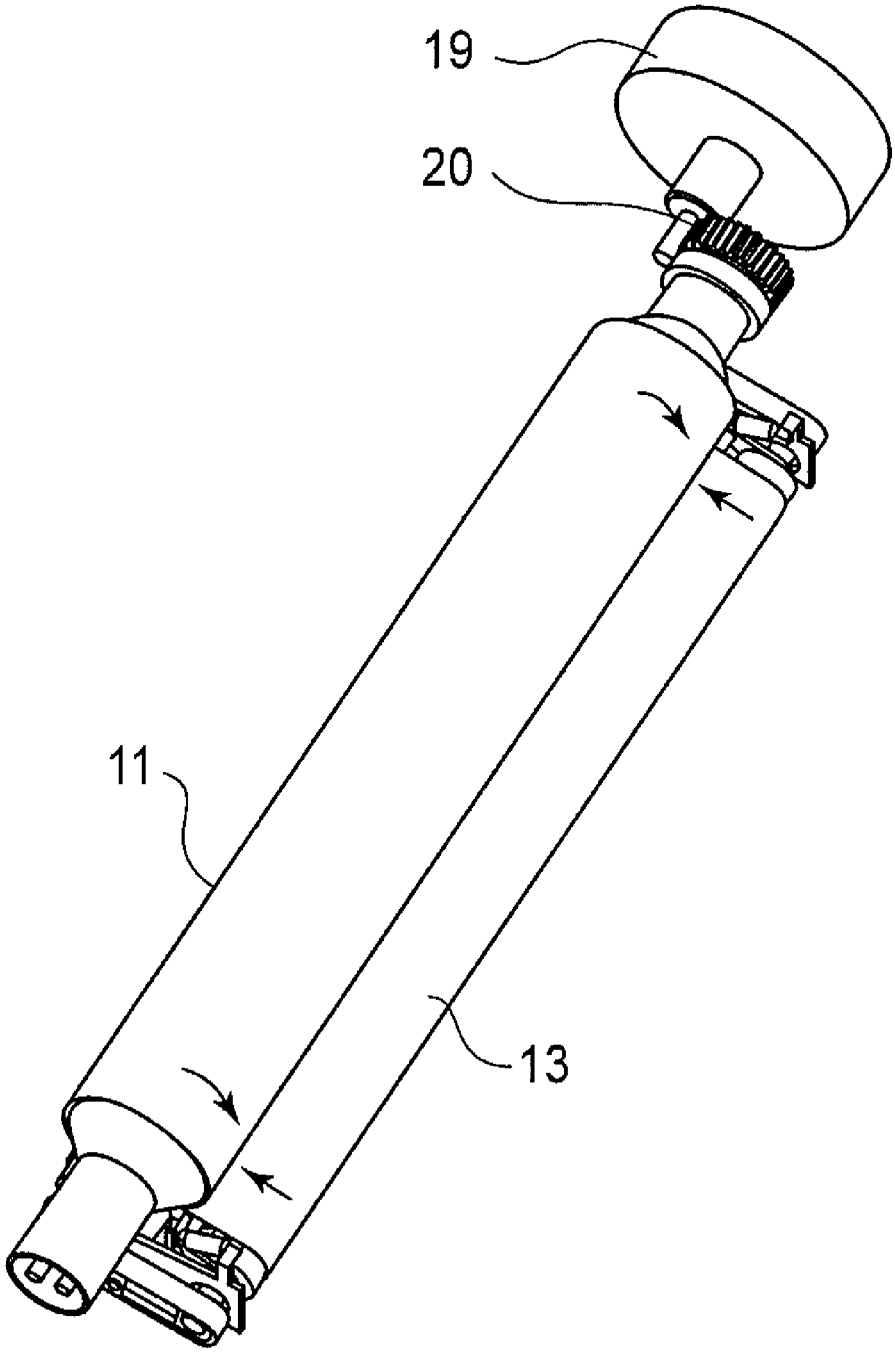
FIG. 2 is a perspective view of the fixing device.

Next, the fixing device as the image heating apparatus including the belt conveying device will be described with reference to FIGS. 1(*a*) and 1(*b*) and FIG. 2. FIGS. 1(*a*) and 1(*b*) illustrate a basic structure of the fixing device, in which FIG. 1(*a*) is a sectional view of the fixing device and FIG. 1(*b*) is a front view of the fixing device. FIG. 2 is a perspective view of the fixing device.

As shown in FIGS. 1(*a*), 1(*b*) and 2, the fixing device 114 includes a heating roller 11 as a rotatable member containing a halogen heater 12 therein. The heating roller 11 is the rotatable member for fixation provided for applying heat generated by the inner halogen heater 12 to the toner on the sheet and for conveying the sheet together with an endless belt 13. The heating roller 11 is rotationally driven by a driving force transmitted from a motor 19 thereto through a gear 20.

The belt conveying device as a rotatable pressing member press-contacts the heating roller 11. The belt conveying device includes the endless belt 13, the pressing roller 14 and the tension roller 15 which are a stretching (supporting) member, the pressing pad 18 as an urging member, and the oil application roller 16 as a lubricant application member. The endless belt 13 is stretched around and supported by the pressing roller 14 as the stretching member and the tension roller 15 having the function of imparting a belt tension, with a predetermined tension (e.g., 100N).

The heating roller 11 includes, e.g., a metal core consisting of a cylindrical aluminum pipe having an outer diameter of 56 mm and an inner diameter of 50 mm and includes the heater 12 in the metal core. The heating roller 11 further includes an elastic layer of a silicone rubber having, e.g., having a thickness of 2 mm and an ASKER-C hardness of 45 degrees on the surface of the metal core and includes a heat resistive parting layer of PFA or PTFE as a surface layer on the elastic layer.

The belt member 13 and the heating roller 11 are rotated at a peripheral speed of 210 mm/sec during sheet conveyance.

As a material for the endless belt 13, any material may be appropriately selected and used so long as the material has heat resistivity and has an inner surface possessing such a strength that the inner surface and the stretching member do not abrade each other. For example, the endless belt 13 may be prepared by coating a 300 μm-thick silicone rubber on a 75 μm-thick polyimide film having a width of 380 mm and a circumferential length of 200 mm. Alternatively, an endless belt 13 prepared by coating a 300 μm-thick silicone rubber on a base material of nickel having a thickness of 75 μm, a width of 380 mm and a circumferential length of 200 mm and by coating a polyimide film having a thickness of about 5 μm on an inner surface of the nickel base material, may be used.

The pressing roller 14 is the stretching member (roller), for stretching the endless belt 13, formed with, e.g., a hollow stainless steel member having an outer diameter of 20 mm. The pressing roller 14 is disposed on an exit side of the nip area (press-contact area) between the pressing roller 11 and the endless belt 13 with respect to the conveying direction and elastically deforms the elastic layer of the pressing roller 11 in a predetermined amount.

The tension roller 15 is, e.g., a hollow roller of stainless steel formed to have an outer diameter of about 20 mm and an inner diameter of about 18 mm and functions as the belt stretching (supporting) roller (stretching (supporting) member).

The pressing pad 18 is such an urging member that it urges the inner surface of the endless belt 13 and includes a contact portion at which a part thereof contacts the pressing roller 14. The pressing pad 18 press-contacts the endless belt 13 against the pressing roller 11 to create the nip together with the pressing roller 14.

Between the pressing pad 18 and the tension roller 15, the oil application roller (lubricant application member) 16 for applying the lubricant onto the inner surface of the endless belt 13 is disposed. The oil application roller is rotatably supported about the rotation axis of the tension roller 15 by a rotatably supported arm 17 and is caused to press contact the inner surface of the endless belt 13 by a spring 21.

The oil application roller 16 is formed with a sheet-like oil application contact film including a heat resistive aramid felt impregnated with a heat resistive silicone oil having a viscosity of about 1000 CS and a porous PTFE layer provided on the surface layer of the aramid felt. The oil application roller 16 supplies (applies) the heat resistive silicone oil as the lubricant to the inner surface of the endless belt 13. The viscosity of the heat resistive silicone oil in this embodiment is about 1000 CS but may appropriately be set depending on an operation condition. However, in the case where a low-viscosity oil having the viscosity of 100 CS or less is used, the oil holding power by the heat resistive aramid felt is lowered, so that the oil is released in a short time. As a result, the oil on the inner surface of the endless belt 13 becomes excessive and the excessive oil is discharged to the outside of the fixing device, so that stable belt conveyance cannot be performed for a long time. Further, in the case where oil having the viscosity of 500,000 CS or more is used, the oil holding power is increased, so that not only a stable oil supply is impaired. but also. sliding resistance between the endless belt 13 and the pressing pad 18 becomes large. As a result, the stable belt conveyance also cannot be performed.

The heat resistive silicone oil supplied onto the inner surface of the endless belt 13 is also supplied to the surfaces of the pressing roller 11 and the tension roller 15 through the inner surface of the endless belt 13.

Figure 3:
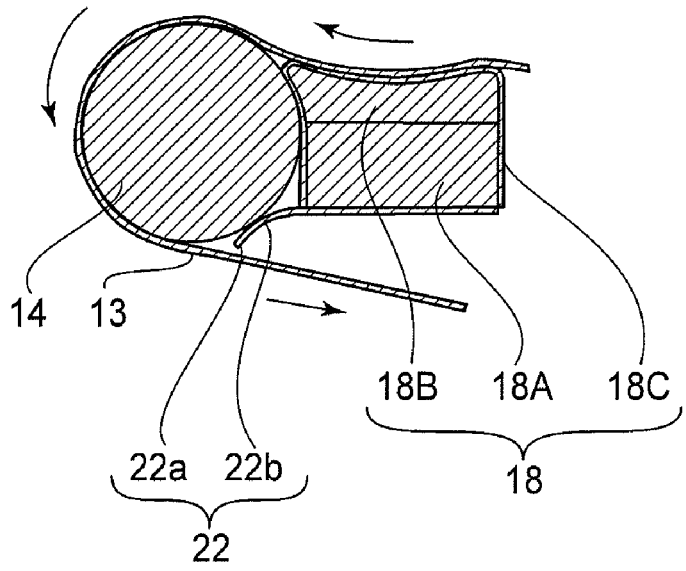
FIG. 3(*a*) is an enlarged sectional view of an oil collecting sheet and its peripheral portion, and FIG. 3(*b*) is an enlarged sectional view for illustrating an oil circulatory path, the oil collecting sheet and the peripheral portion of the oil collecting sheet.
Figure 3:
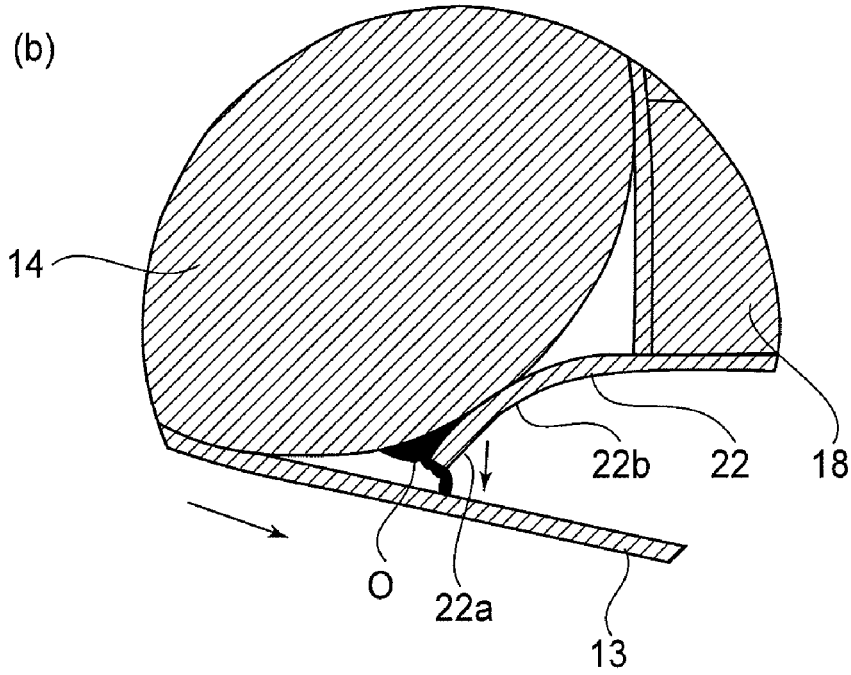
Figure 4:
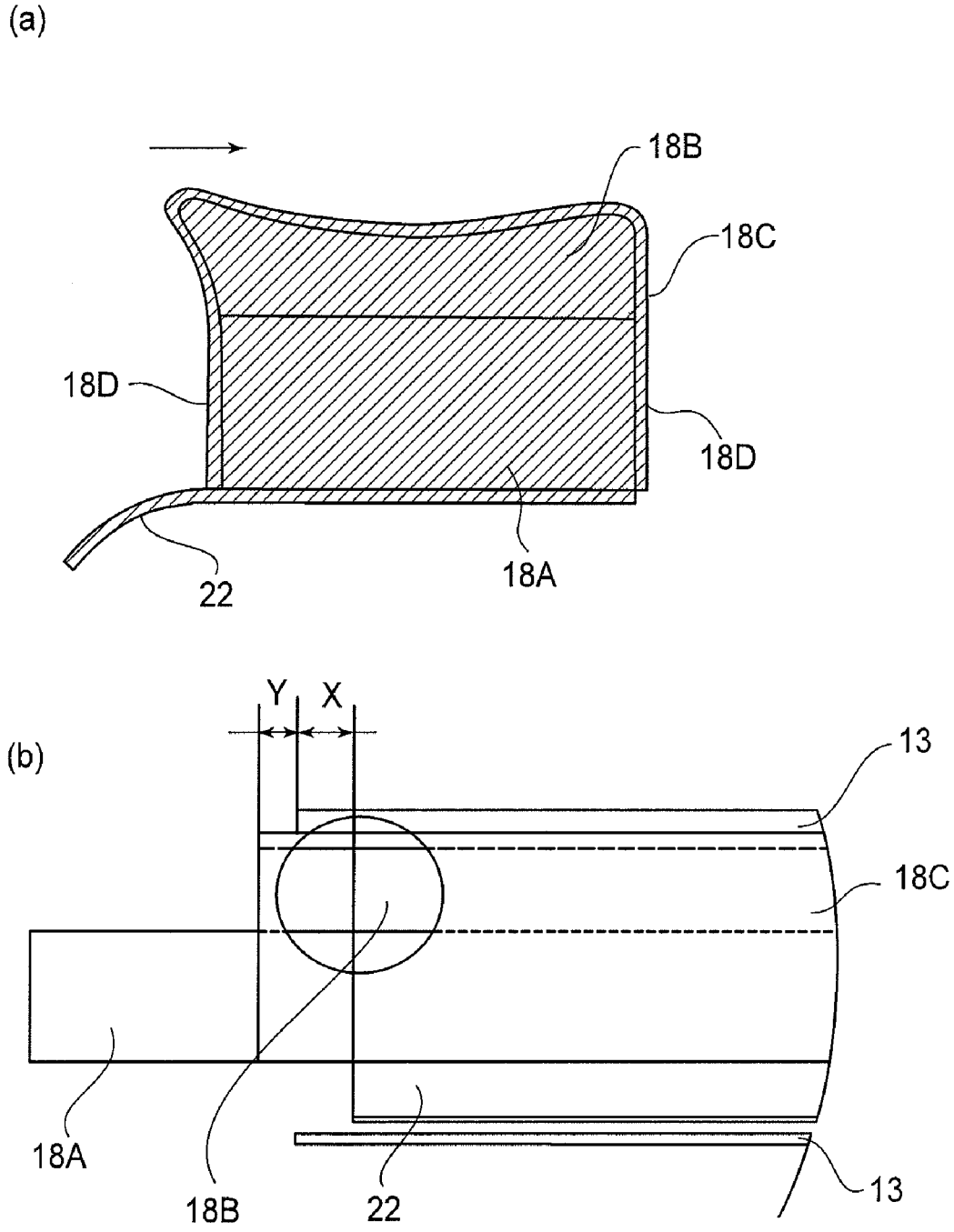
FIG. 4(*a*) is a sectional view of the pressing pad, and FIG. 4(*b*) is an enlarged view of a main part of the pressing pad for illustrating a length relationship of the pressing pad.

Then, with reference to FIGS. 3(*a*), 3(*b*), 4(*a*) and 4(*b*), the pressing pad 18 will be described more specifically. FIG. 3(*a*) is an enlarged sectional view of an oil collecting sheet and its peripheral portion, and FIG. 3(*b*) is an enlarged sectional view for illustrating an oil circulatory path, the oil collecting sheet and the peripheral portion of the oil collecting sheet. FIG. 4(*a*) is a sectional view of the pressing pad, and FIG. 4(*b*) is an enlarged view of a main part of the pressing pad for illustrating a length relationship of the pressing pad.

As shown in FIGS. 4(*a*) and 4(*b*), the pressing pad 18 is constituted by three members of the pad holder 18A, the pad rubber 18B and the low friction sheet 18C and is constituted by an oil collecting sheet 22 as a lubricant collecting member.

The pad holder 18A is formed of SUS (stainless steel) in order to have sufficient strength for permitting nip creation. The pad rubber 18B is formed with an elastic member of silicone rubber or the like formed on the pad holder 18A in order to uniformize the nip pressure distribution. The low friction sheet 18C is provided in order to decrease the friction resistance between the pad rubber 18B and the endless belt 13 or the pressing roller 14.

As shown in FIG. 4(*a*), the low friction sheet 18C is fixed, at a fixed surface 18D, on the pad holder 18A so as to cover the entire side surface of the pad holder 18A and the entire side and upper surfaces of the pad rubber 18B. The pressing pad 18 contacts the pressing roller 14 at the surface on the pressing roller 14 side in order to prevent pressure from being locally applied in the nip between the heating roller 11 and the endless belt 13, so that the pressing roller 14 backs up the pad rubber 18B.

Figure 6:
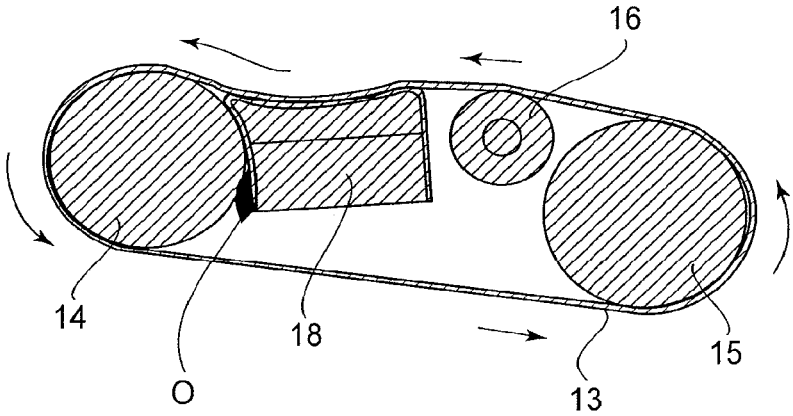
FIG.6 PRIOR ART
FIG. 6 is a sectional view showing a stagnant oil position in a conventional fixing device.

The heat resistive silicone oil applied onto the inner surface of the endless belt 13 is also supplied to the pressing roller 14 and the tension roller 15 through the endless belt 13. Although described above, the inner surface material of the endless belt 13 is polyimide used as the base material or coated on the nickel base material, and the material for the pressing roller 14 is stainless steel. With respect to these materials, affinity of the heat resistive silicone oil for stainless steel is higher than that for polyimide. For that reason, at a portion where the state of the endless belt 13 and the pressing roller 14 which have contacted each other is changed to a non-contact state, the heat resistive silicone oil applied on the endless belt 13 adheres to the pressing roller 14 side relative to the endless belt 13. Then, the heat resistive silicone oil having adhered to the pressing roller 14 side stagnates at the contact portion where the pressing roller 14 starts the contact with the pressing pad 18 (FIG. 6).

Therefore, the oil collecting sheet 22 as the collecting member for collecting the oil contacting and adhering to the surface of the pressing roller 14 and for guiding the collected oil to the inner surface of the endless belt 13 is provided. This oil collecting sheet 22 is provided in contact with the pressing roller 14 at a portion upstream of the pressing pad 18 contacting the pressing roller 14 with respect to the rotational direction of the pressing roller 14 in a non-contact area of the pressing roller 14 with the endless belt 13. That is, the oil collecting sheet 22 is fixedly disposed on the pressing pad 18 and is provided in press-contact with the pressing roller 14 on its end portion side at an intermediate position between a position where the pressing roller 14 is spaced from the endless belt 13 and a position where the pressing roller 14 contacts the pressing pad 18. Further, the oil collecting sheet 22 is supported by the pressing pad 18.

The material for the oil collecting sheet 22 in this embodiment is a polyimide film having a thickness of 75 μm. The oil collecting sheet 22 press-contacts the pressing roller 14 over the entire full length area with respect to the axial (shaft) direction of the pressing roller 14. When the oil applied on the pressing roller 14 is collected completely, the contact resistance between the pressing roller 14 and the pressing pad 18 becomes large. Further, the amount of oil present at the contact surface between the pressing roller 14 and the endless belt 13 is also decreased. For that reason, the contact pressure between the oil collecting sheet 22 and the pressing roller 14 is required to be 0 MPa or more (reliably contacting state) and less than the contact pressure (0.1 MPa in this embodiment) between the pressing roller 14 and the pressing pad 18.

FIG. 4(*b*) shows the positional relationship among end portions of respective members constituting the pressing pad 18 and the endless belt 13 as seen from a direction indicated by an arrow in FIG. 4(*a*).

The oil collecting sheet 22 is shorter than the endless belt 13 with respect to the axial direction (a widthwise direction perpendicular to the rotational direction). Specifically, the pad rubber 18B is disposed inward so as to be shorter than the endless belt 13 by a length X (4 mm in this embodiment) with respect to the widthwise direction, and the low friction sheet 18C is disposed outward so as to be longer than the endless belt 13 by a length Y (3 mm in this embodiment) with respect to the widthwise direction. The oil collecting sheet 22 is, similarly as in the case of the pad rubber 18B, disposed inward so as to be shorter than the endless belt 13 by the length X (4 mm) with respect to the widthwise direction.

As shown in FIGS. 3(*a*) and 3(*b*), the oil collecting sheet 22 contacts the circumferential surface of the pressing roller 14 on a lower side below the rotation center of the pressing roller 14 with respect to the vertical direction. Further, the oil collecting sheet 22 surface-contacts the circumferential surface so that an end portion 22*a* thereof does not contact the pressing roller 14. Further, the non-contact end portion 22*a* of the oil collecting sheet 22 is located below a contact portion 22*b* at which the oil collecting sheet 22 contacts the pressing roller 14 with respect to the vertical direction. More specifically, the end portion 22*a*, which does not contact the pressing roller 14, of the oil collecting sheet 22 is disposed downward. Incidentally, the end portion 22*a* and the inner surface of the endless belt 13 provide a positional relationship such that they oppose each other with a spacing therebetween. That is, the end portion 22*a* and the inner surface of the endless belt 13 do not contact each other. Thus, the oil collecting sheet 22 has the downward end portion 22*a* that is capable of increasing the amount of collected oil guided onto the inner surface of the endless belt 13 through the end portion 22*a* to be circulated by the endless belt 13. That is, the oil collecting sheet is configured to include the guiding portion for guiding the oil from the portion at which the oil collecting sheet 22 contacts the pressing roller 14 to the end portion 22*a*. Further, as described above, the oil collecting sheet 22 is disposed so as to be shorter than the endless belt 13, so that the collected oil is not discharged to the outside of the endless belt 13.

As a result, the amount of the oil remaining at the portion where the pressing roller 14, to which a relatively large amount of the oil adheres, and the pressing pad 18 start contact therebetween is decreased. Further, the amount of the oil discharged to the outside of the endless belt 13 through the surface of the low friction sheet 18C on the pressing pad 18 is also decreased. Further, the oil collected by the oil collecting sheet 22 flows toward the end portion 22*a* of the oil collecting sheet 22 and drops on the inner surface of the endless belt 13. For that reason, the heat resistive silicone oil which has been conventionally discharged to the outside of the endless belt 13 is circulated on the inner surface of the endless belt 13 without being discharged to the outside of the endless belt 13.

Further, the length of the oil collecting sheet 22 with respect to the roller axial direction may preferably be shorter than that of the endless belt 13 in order that the collected oil can drop onto the endless belt 13. In this embodiment, the oil collecting sheet 22 is disposed inside the end surface (edge) of the endless belt 13 by the length X (4 mm).

As a result, the oil stagnation at the portion where the pressing roller 14 and the pressing pad 18 start the contact therebetween can be alleviated, so that the discharge amount of the heat resistive silicone oil which has been conventionally discharged to the outside of the endless belt 13 can be decreased. Therefore, the heat resistive silicone oil as the lubricant can be retained on the inner surface of the endless belt 13 for a long time. Thus, it becomes possible to realize a service life extension of the belt inner surface oil and prevention of image defects and apparatus contamination due to the discharge of the oil to the outside of the fixing device.

As described above, the oil adhering from the inner surface of the endless belt 13 to the pressing roller 14 can be collected by the oil collecting sheet 22 before the oil reaches the contact portion 22*b* contacting the pressing roller 14 and can be guided onto the inner surface of the endless belt 13. By such a simple constitution, it is possible to prevent the oil on the inner surface of the endless belt 13 from leaking out of the both end portions of the endless belt 13 with respect to the widthwise direction, so that a belt conveying device excellent in durability can be provided.

Further, in the above-described embodiment as the image heating apparatus, the fixing device for fixing the toner image on the recording material is exemplified but the present invention is not limited thereto. For example, as another example, a glossiness-increasing apparatus (device) for increasing the glossiness of the image by heating the toner image fixed on the recording material can be exemplified.

Further, in the above-described embodiment, of the rotatable member for the fixation and the rotatable member for the pressing which constitution the belt fixing device, the rotatable member for the pressing (one of the rotatable members) is described as the belt conveying device but the constitution of the present invention is not limited thereto. For example, it is also possible to employ a constitution in which the rotatable member for the fixation (the other rotatable member) is the belt conveying device or a constitution in which both of the rotatable members are the belt conveying device. A similar effect can be obtained by applying the present invention to these belt conveying devices.

Further, in the above-described embodiment, as the material for the pressing roller, stainless steel is exemplified but the material is not limited thereto. The pressing roller may only be required that its surface material is metal. Further, as the material for the inner surface of the endless belt, polyimide is exemplified but the material is not limited thereto. The inner surface material of the end portion may only be required to be the polymeric material.

Further, in the above-described embodiment, the printer is exemplified as the image forming apparatus but the present invention is not limited thereto. For example, other image forming apparatuses such as a copying machine, a facsimile machine, a multi-function machine having a combination of the functions of the above-described machines may also be used as the image forming apparatus in the present invention. Further, in the present invention, the image forming apparatus in which a recording material conveying member (conveyer belt) is used and respective color toner images are successively transferred onto the recording material carried on the recording material conveying member may also be employed. It is also possible to employ the image forming apparatus in which an intermediary transfer member (intermediary transfer belt) is used and the respective color toner images are successively transferred onto the intermediary transfer member and then are collectively transferred from the intermediary transfer member onto the recording material. By applying the present invention to the belt conveying device used in these image forming apparatuses, a similar effect can be achieved.

Further, in the above-described embodiment, the belt conveying device in the image forming apparatus is exemplified but the present invention is not limited thereto. The present invention is also applicable to the belt conveying device for decreasing the friction resistance between the belt member and the belt sliding surface by applying the lubricant onto the inner surface of the belt member.

According to the present invention, the lubricant taken from the inner surface of the endless belt by the stretching member can be collected by the lubricant collecting member before the lubricant reaches the contact portion at which the urging member contacts the stretching member and can be guided onto the inner surface of the endless belt.

By such a simple constitution, it is possible to provide the image heating apparatus capable of preventing the lubricant on the inner surface of the belt member from leaking out of the end portion and capable of being excellent in durability.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 163695/2009 filed Jul. 10, 2009, which is hereby incorporated by reference.

What is claimed is:

1. An image heating apparatus comprising:

an endless belt;

a rotatable member, contactable to an outer surface of said endless belt, configured to form a nip in which a recording material is nipped and conveyed;

a stretching member configured to stretch said endless belt;

an urging member, contacting an inner surface of said endless belt, configured to urge said stretching member by movement of said endless belt so as to include a contact portion at which said urging member contacts said stretching member;

a lubricant application member configured to apply a lubricant onto the inner surface of said endless belt; and a collecting member, contacting said stretching member at a position downstream of an area in which said stretching member contacts said endless belt and upstream of the contact portion at which said urging member contacts said stretching member with respect to a rotational direction of said stretching member, and configured to collect the lubricant from said stretching member, wherein said collecting member includes a guiding portion configured to guide the lubricant, collected from said stretching member, onto the inner surface of said endless belt.

2. An apparatus according to claim 1, wherein said collecting member is an elastic sheet.

3. An apparatus according to claim 1, wherein said collecting member is shorter than said endless belt with respect to an axial direction of said stretching member.

4. An apparatus according to claim 1, wherein the inner surface of said endless belt is formed of a polymeric material and a surface of said stretching member is formed of metal.

5. An apparatus according to claim 1, wherein said collecting member contacts a circumferential surface of said stretching member at a position below a rotation center of said stretching member with respect to a vertical direction.

6. An apparatus according to claim 1, wherein said collecting member includes an end portion located below a contact portion, at which said collecting member contacts said stretching member, with respect to the vertical direction.

7. An apparatus according to claim 6, wherein the end portion of said collecting member opposes the inner surface of said endless belt with a spacing therebetween.

8. An apparatus according to claim 1, wherein said rotatable member is a heating member configured to heat an image on the recording material.

9. An apparatus according to claim 1, wherein said urging member is a pressing pad.

10. An apparatus according to claim 1, wherein a contact pressure between said collecting member and said stretching member is smaller than that between said urging member and said stretching member.

11. An apparatus according to claim 1, wherein said collecting member is supported and fixed by said urging member.

* * * * *